US007661177B2

(12) United States Patent
Bloomfield

(10) Patent No.: US 7,661,177 B2
(45) Date of Patent: Feb. 16, 2010

(54) WAIST SIZE-ADJUSTING DEVICE

(76) Inventor: Randall C. Bloomfield, P.O. Box 6713, Villa Park, IL (US) 60181

( * ) Notice: Subject to any disclaimer, the term of this patent is extended or adjusted under 35 U.S.C. 154(b) by 449 days.

(21) Appl. No.: 11/420,268

(22) Filed: May 25, 2006

(65) Prior Publication Data

US 2007/0271737 A1 Nov. 29, 2007

(51) Int. Cl.
*A44B 11/00* (2006.01)
*A41F 1/00* (2006.01)

(52) U.S. Cl. ..... 24/163 R; 24/71 R; 2/235

(58) Field of Classification Search ..... 2/235–237, 2/311, 312, 321, 322; 24/71 R, 71 T, 71 ST, 24/68 AS, 68 A, 68 E, 68 T, 307, 308, 310, 24/311, 170, 182, 191, 193, 197
See application file for complete search history.

(56) References Cited

U.S. PATENT DOCUMENTS 473,297 A * 4/1892 Corser ..... 24/265 R
1,966,063 A * 7/1934 Domler ..... 24/71 R
2,024,487 A * 12/1935 Tost ..... 24/71 R
2,057,589 A * 10/1936 Prestinari ..... 24/71 R
RE21,753 E * 3/1941 Davis ..... 24/71 R
3,703,729 A * 11/1972 Hinderer ..... 2/237
5,613,249 A 3/1997 Ito
6,425,139 B1 7/2002 Ida

* cited by examiner

*Primary Examiner*—Robert J Sandy
(74) *Attorney, Agent, or Firm*—Invention Protection Associates, LLC

(57) ABSTRACT

A waist adjusting device for reducing the waist size of pants without the use of a belt is provided. The device comprises two engaging members and a connecting member which is pivotally attached to both engaging members. The engaging members each have clips disposed thereupon to permit them to be selectively fastened to spaced apart points along a pant waistline. With the engaging members fastened onto the pant, the device contracts the waist by the engaging members being pivoted about the connecting member such that the clips are drawn closer together.

8 Claims, 6 Drawing Sheets

WAIST SIZE-ADJUSTING DEVICE

BACKGROUND OF THE INVENTION

The present invention generally relates to a device for adjusting the waist size of pants. The invention is specifically directed to a device adapted for easy attachment to and removal from a pants or skirt waist and further adapted for quick adjustment of the waist size, thus, allowing otherwise loose pants to be fittingly worn without the supportive aid of a waist belt or suspenders.

The prior art is replete with various embodiments of belts and buckles which are used in combination to adjust the waist size of pants. Typically, a buckle is fixedly attached to an end of a belt and is adapted to engage the belt at various positions, often by way of a buckle prong being fitted within any of a plurality of apertures residing along the length of the belt. In order to don a buckled belt, the pant-wearing user guides the free end of the belt through the loops along the pant waistline until the belt completely encircles his waist and the buckle is vertically aligned with his navel. While maintaining the buckle's alignment, the user further draws the free end of the belt around his waist until the coiling belt constricts his pant waist adequately to prevent the pants from sliding downward during wear. The user then secures the buckle to the belt. Generally, the variability of buckle engagement points along a belt allow it to be effectively worn by users of a range of different waist sizes.

Belts can present some disadvantages, however. For instance, while most belts can fit multiple waist sizes, few can accommodate every conceivable waist size. A belt sized to fit around the waist of a large-girthed man is likely too long to be effectively worn by a much slimmer person. Accordingly, belts, like pants themselves, are usually manufactured and sold in standardized sizes that indicate length and are not universally wearable. Furthermore, because of color, finish, texture or other stylistic matters unrelated to proper fit, a user may find a particular belt compatible for use with only a limited portion of his clothing wardrobe.

The prior art also includes several other types of devices for adjusting the waist dimensions of lower body garments that are not designed to encircle the waist area in belt-like fashion. For example, U.S. Pat. No. 5,613,249 to Ito discloses an apparatus comprised of a horizontally oriented guide tape and a slider component, both attachable to a pant waist, wherein the slider is slidably movable along and selectively engageable to the guide tape to allow for waist size adjustment by virtue of selective overlapping of portions of the pant waist. U.S. Pat. No. 6,425,139 to Ida discloses a conceptually similar device which comprises a short adjusting belt and a slider component. Both of these patented devices allow a person to adjust his pants waist size without the use of a more sizeable buckled belt.

However, such compact waist-adjusting devices of the prior art are not without disadvantage. To wit, they generally must be (semi-)permanently affixed to a particular garment, making them inconvenient or even impossible to utilize with multiple garments. So, a person may need to possess a different prior art waist-adjusting article to use with each pair of loose-fitting pants that he wishes to apply the article to.

Consequently, it can be appreciated that there exists a need for a waist size-adjusting device that is easily compactable and is removable from clothing such that a single device can be transferred onto virtually every item in a user's pant wardrobe. Furthermore, there exists a need for such a device to be inconspicuous and/or aesthetic so as to render it fashionable for wear with a wide variety of pants. The waist size-adjusting device of the present invention may substantially fulfill these needs.

SUMMARY

The present invention is a mechanical device that is removably attachable to pants and that permits one to selectively contract the pants' waist size dimension. Its inventor contemplates the device being used on pants in lieu of belts for utilitarian purposes in some instances and for purely aesthetic reasons in other instances.

A preferred embodiment of the present device comprises a few simple components including: a U-shaped first engaging member, a T-shaped second engaging member and U-shaped connecting member that is pivotally connected to both engaging member. The orientation of device members allows the device to be rotatably toggled between a closed position and a range of open positions, wherein the closed position is distinguished by all three members being in a vertically overlapping and generally concentric relation within a common dimensional plane, and the open positions are conversely defined by the U-shaped members being rotated out of the common plane. Separate clips for fastening the device onto a pant waistline are disposed adjacent to the bottom section of the U-shaped first engaging member and at an end of the crossbar section of the T-shaped second engaging member, respectively, such that the U and T shapes are horizontally oriented when the clips are secured to a pant waist. A releasable latch pin mechanism is also provided for holding the device members in fixed relationship when the device is in closed position.

A user can apply the device to a pair of pants and contract the pants waistline by executing the four simple steps of: (1) unfurling the device to an open position by pivoting the connecting member such that the engaging members are pulled a desired distance apart from each other; (2) fastening the clips to selectively spaced points along the pant waistline; (3) reverse pivoting the connecting member to draw the engaging members back together into an overlapping, closed position and to, thereby, bunch together a short section of the waistline; and (4) engaging the latch pin to lock the device members together.

It is, therefore, an object of the present invention to provide a waist size-adjusting device of simple construction and use. It is also an object of the invention to provide such a device that permits a broad range of waist adjustment in order that a single device may be adapted for effective use by many potential users despite wide variations in the fit of their pants.

DETAILED DESCRIPTION OF THE PREFERRED EMBODIMENTS

Figure 1:
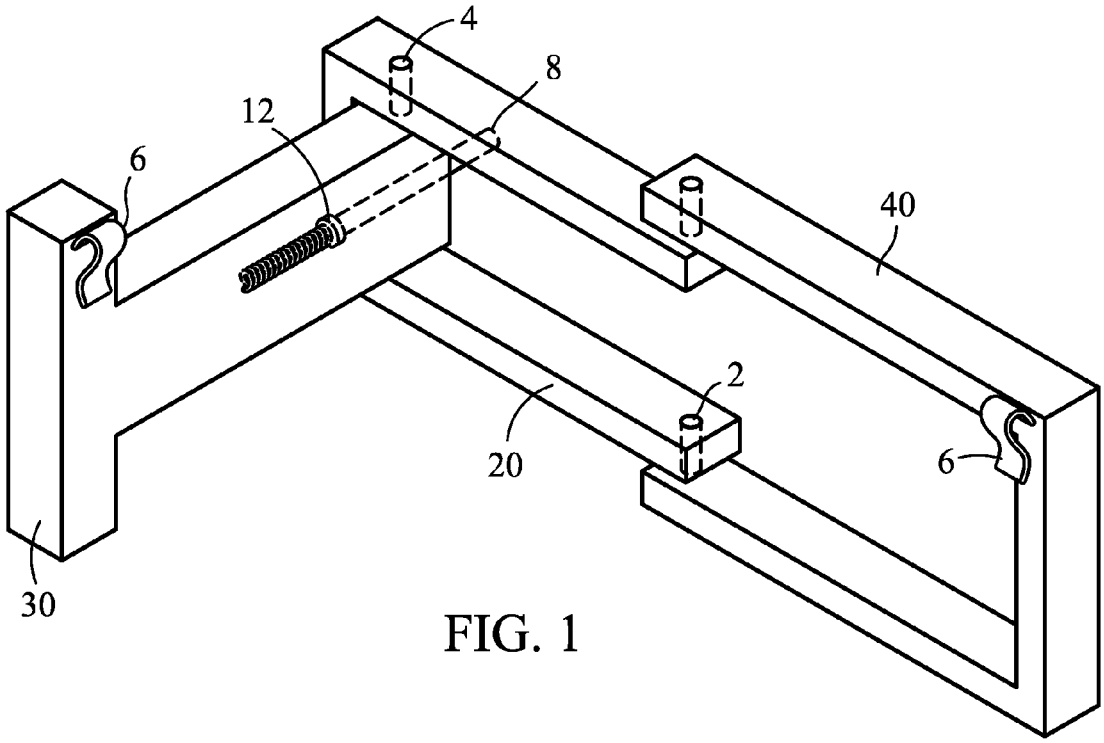
FIG. 1 is a top and rear perspective view of a waist size-adjusting device of the present invention while in an opened position.

FIG. 1 illustrates an embodiment of the present invention—an embodiment whose fully integrated components include: a horizontally oriented, U-shaped, first engaging member 40; a horizontally oriented, U-shaped connecting member 20; a horizontally oriented, T-shaped, second engaging member 30; a pair of waist clips 6; and a latching mechanism.

Figure 2:
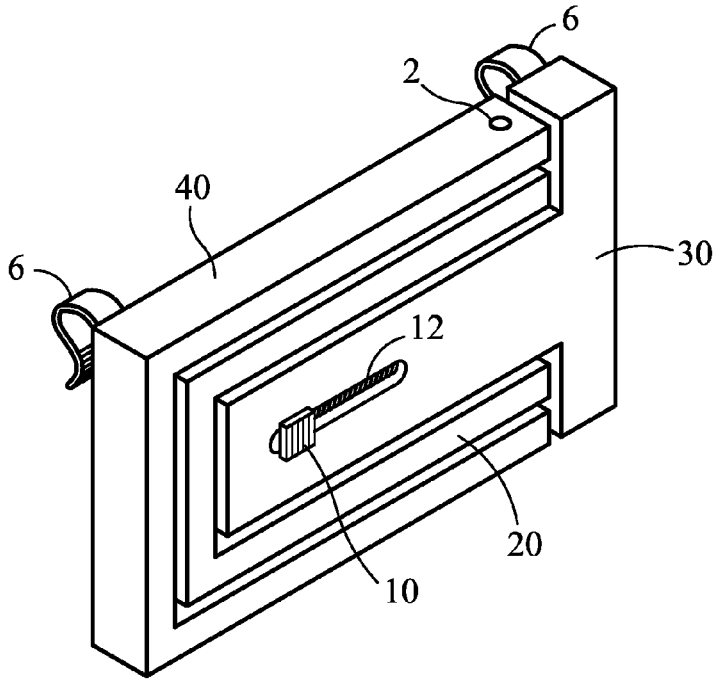
FIG. 2 is a top and front perspective view of the device of FIG. 1, but while in the closed position.
Figure 9:
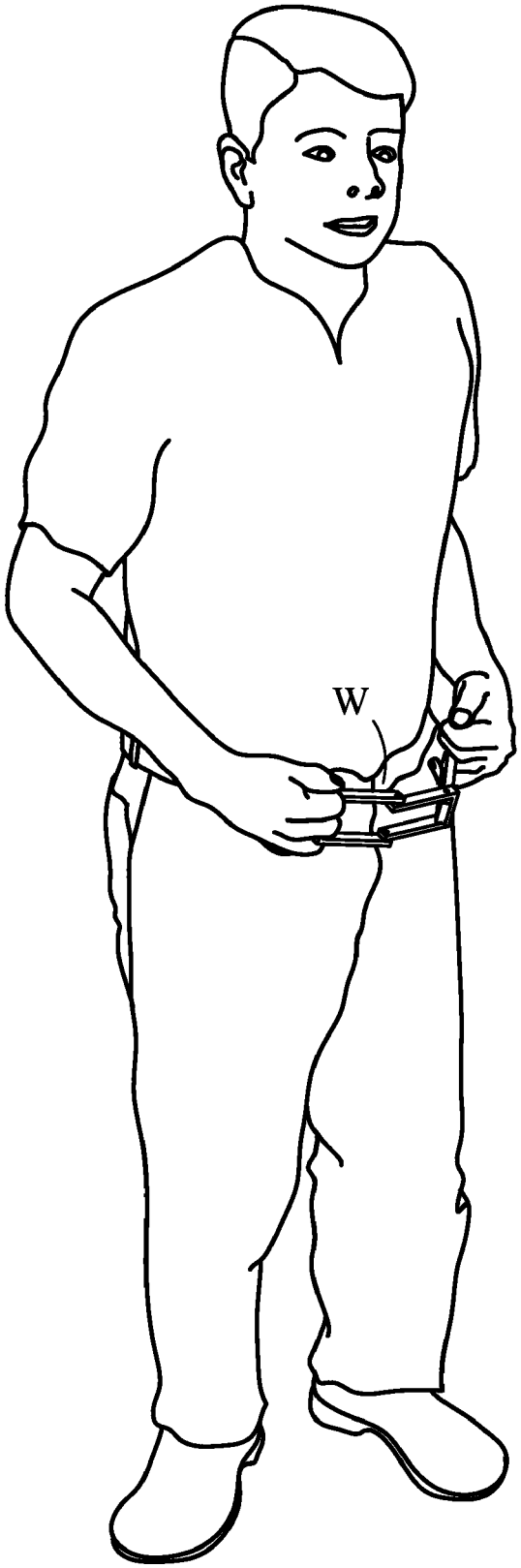
FIG. 9 is a schematic top and front perspective view of the device of FIG. 1 immediately prior to being applied to pants for use.

The first engaging member 40 and connecting member 20 are pivotally connected via a coaxial pair of pivot pins 2 traversing both U-shaped articles 20, 40 near their respective open ends. Consequently, the connecting member 20 may be pivoted between a closed position in which the connecting member 20 and first engaging member 40 are planarly aligned in concentric relationship, as shown in FIG. 2, and a fully opened position in which the U-shaped articles 20, 40 are axially aligned in facing relation, as is depicted in FIG. 1. The connecting member 20 is also pivotally attached to the second engaging member 30 by way of a second pair of coaxial pivot pins 4 which are traversely disposed along the connecting member 20 and the second engaging member's stem portion 30*a*, respectively. The second engaging member 30 may thus be pivoted between a closed position in which the second engaging member 30 and connecting member 20 are planarly aligned, as shown in FIG. 2, and a range of opened positions in which the second engaging and connecting members 30, 20 are not axially aligned, as is depicted in FIGS. 1 and 9.

The three letter-shaped members 20, 30, 40 are lockable into their aforementioned closed positions by virtue of locking means. Although the particular embodiment of locking means may vary greatly, the locking means illustrated herein comprises a spring-loaded latching mechanism. Specifically, within the stem portion 30*a* of the T-shaped second engaging member 30 is an open-ended and cylindrical chamber 18, and axially disposed therewithin are a latch pin 8 and spring 12. The latch pin 8 is a cylindrical piece which is a slip fit inside the chamber 18. The pin 8 and spring 12 are oriented within the second engaging member's hollowed chamber 18 such that one end of the spring abuts the closed end of the cavity 18 while its opposite end presses against the proximal end 16 of the latch pin 8. Thus, the spring 12 biases the latch pin 8 toward and through the open end of the cavity 18. However, the latch pin 8 is slidably retracted by manipulation of a thumb control 10. The thumb control 10 is affixed to and projects away from the latch pin 8, protruding through a slit 14 along the front face of the second engaging member 30.

When the three members 20, 30, 40 are aligned in concentric relation and the thumb control 10 is then released, the latch pin 8 propels from the stem section 30*a* of the second engaging member 30 and through an aligned hole (not shown) in the closed end of the U-shaped connecting member 20, lodging into a mating slot (not shown) that resides in the closed end of the U-shaped engaging member 40. Thus, the extended latch pin 8 locks the device 1 into closed position. Conversely, when the thumb control 10 is manually guided toward the second engaging member's crossbar section 30*b*, the spring 12 is compressed, and the latch pin 8 becomes entirely withdrawn into the second engaging member 30. This retraction of the latch pin 8 from the first engaging and connecting members 40, 20 enables all three the device members 20, 30, 40 to pivot relative to one another.

Figure 3:
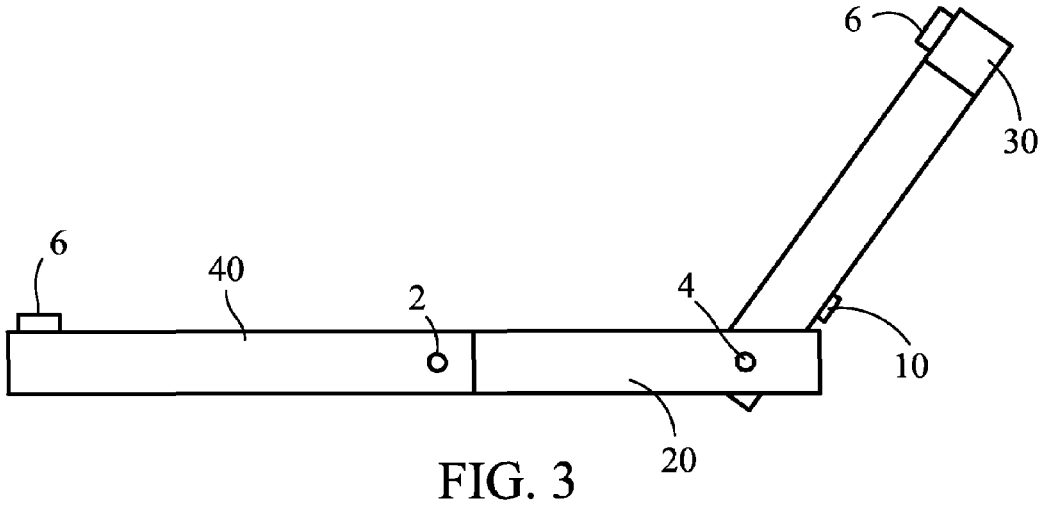
FIG. 3 is a top plan view of the device of FIG. 1 while in an opened position.
Figure 4:
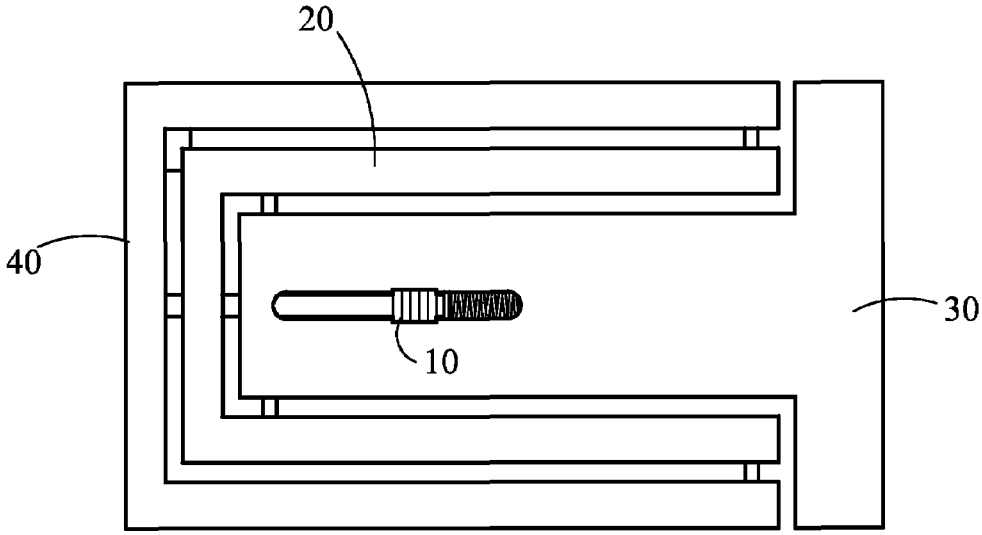
FIG. 4 is a front elevational view of the device of FIG. 1 while in the closed position.
Figure 5:
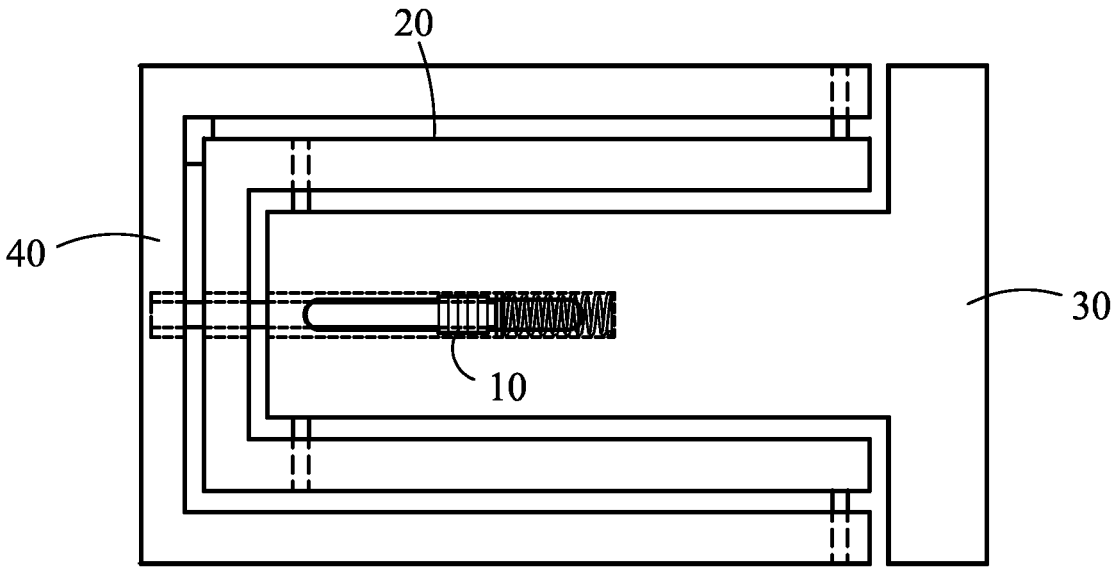
FIG. 5 is a front elevational view of the device of FIG. 1 while in the closed position.
Figure 6:
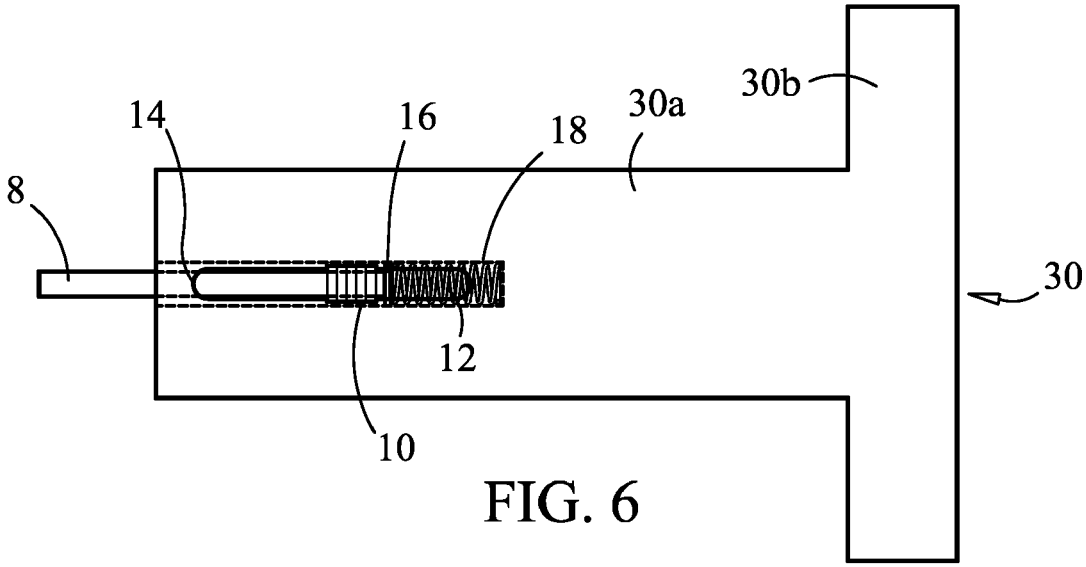
FIG. 6 is a front elevational view of the second engaging member and latching mechanism components of the device of FIG. 1.
Figure 7:
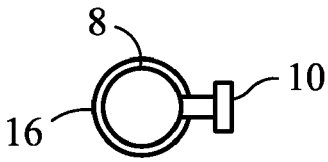
FIG. 7 is an isolated, end elevational view of the latch pin and accompanying thumb control.

The device 1, while opened as it is in FIG. 3, may be applied to beltless pants by, first, firmly placing over the pants waist W the clip 6 disposed along the first engaging member 40. Next, the connecting member 20 is pivoted relative to the first engaging member 40, and the second engaging member 30 is pivoted relative to the connecting member 20, both such that the clip 6 disposed along the second engaging member 30 can also be fastened over the pants waist W. FIG. 9 illustrates an example of the relative orientation of device members during initial placement of the device 1 on the waistline W. A user selects the appropriate points of clip placement based upon the extent to which he wishes to constrict the pants waist W. The further apart the two clips 6 are selectively placed along the waist W, the greater the device, when closed, will reduce waist size.

Figure 8:
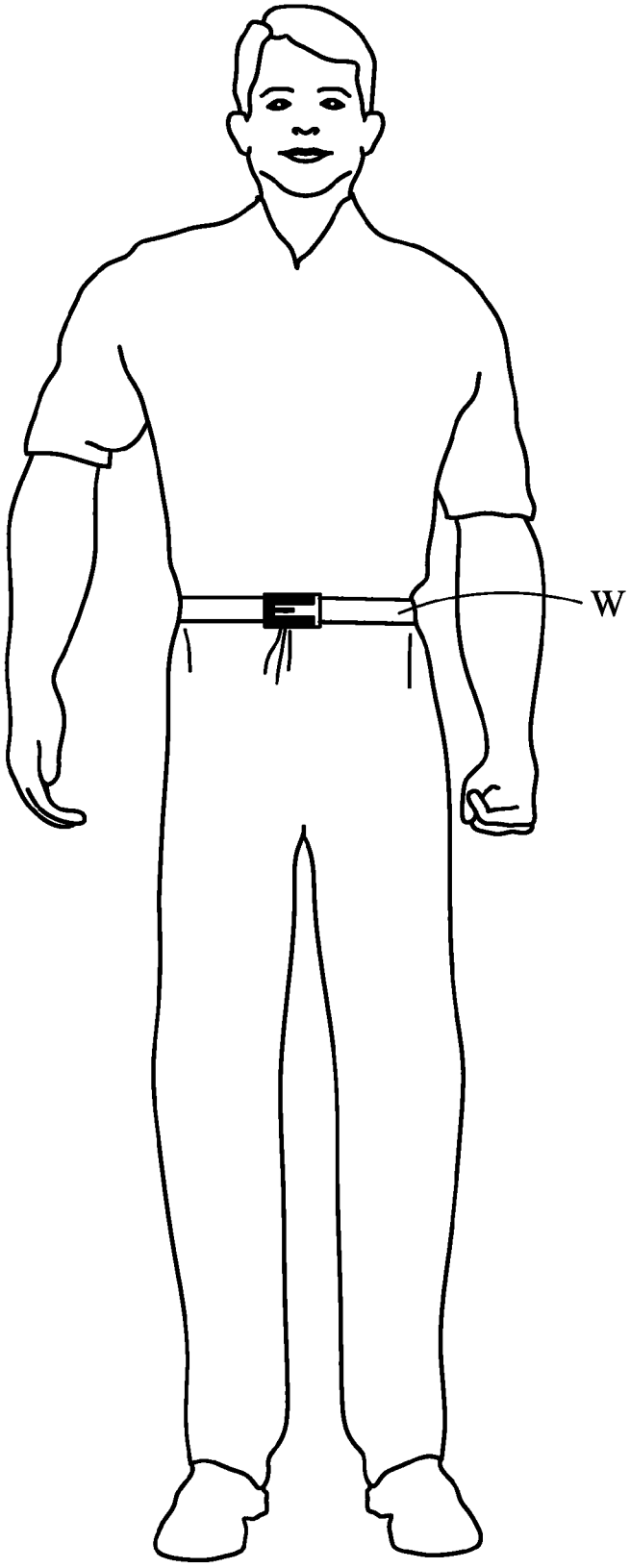
FIG. 8 is a schematic front elevational view of the device of FIG. 1 while applied to and in use on pants.

Nevertheless, with the first engaging member 40 and second engaging member 30 both selectively fastened to the waist W, the latch pin 8 is retracted (by operation of the thumb control 10) and the engaging and connecting members 40, 30, 20 are pivoted into a mutually closed position defined by them being vertically overlapping and in generally concentric relation with each other, as shown in FIG. 8. Consequently, the clips 6 are drawn closer together, and assuming that the clips 6 do not slip relative to the points at which they were initially fastened to the waist W, this pivoting action will bunch the proximate segment of the waist W, thus, reducing waist size. To inhibit clip slippage along the pants fabric, the clips 6 feature roughened inner surfaces, as is apparent in FIG. 2. Finally, the thumb control 10 is released, and the spring 12 biases the latch pin 8 through the connecting member 20 and into the first engaging member 40, thereby locking the device 1 into its closed position.

Figure 10:
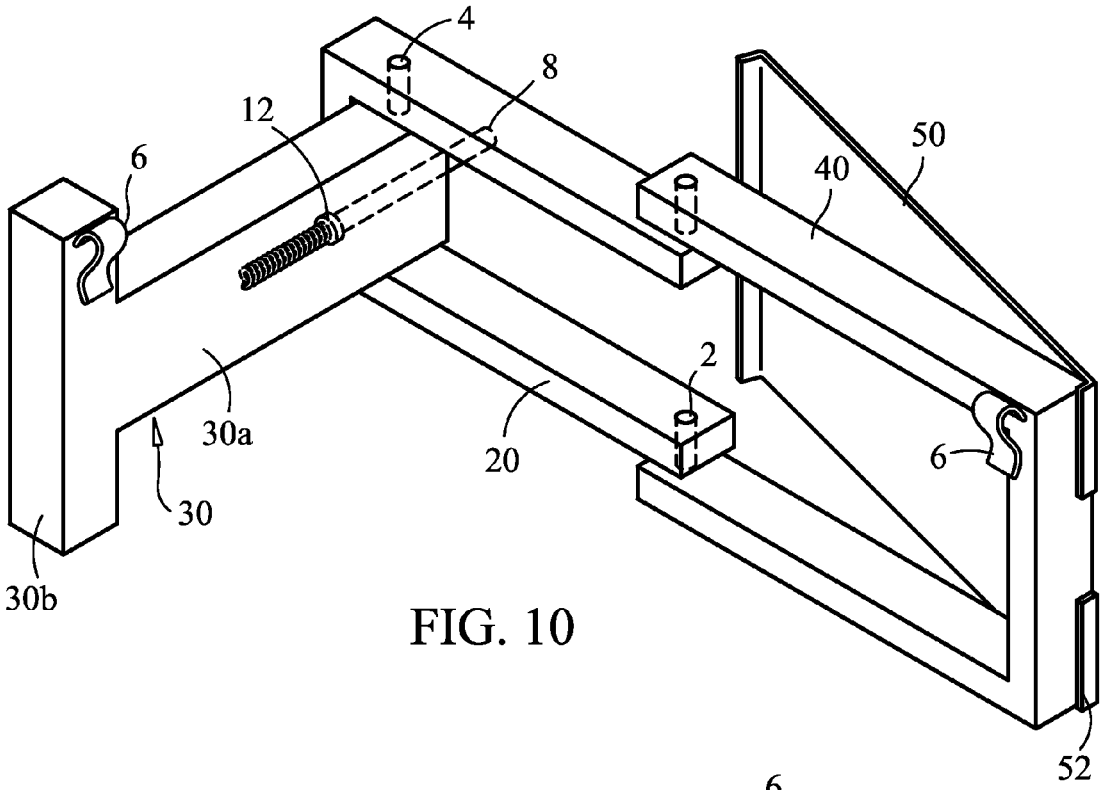
FIG. 10 is a top and rear perspective view of an alternative embodiment of the device of FIG. 1, an embodiment which further includes a front cover component.
Figure 11:
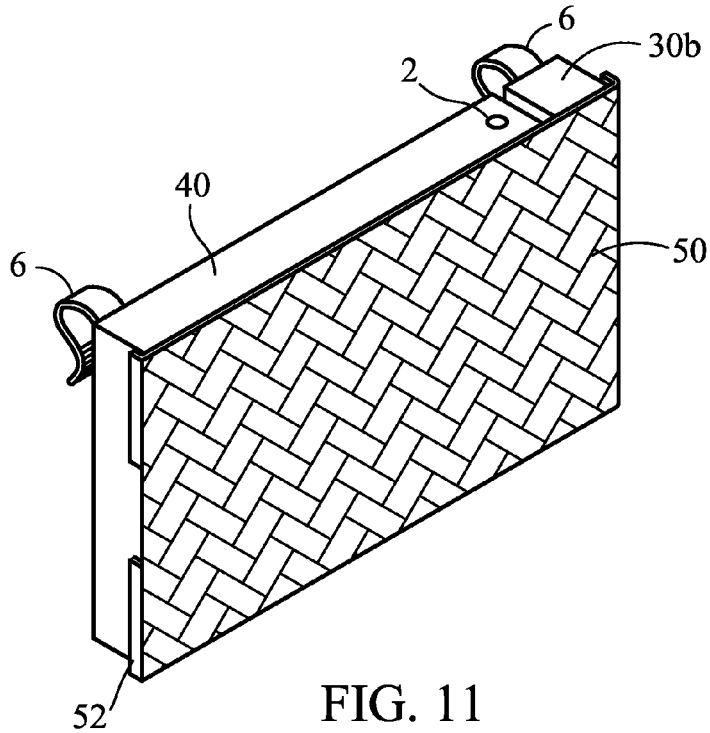
FIG. 11 is a top and front perspective view of the device of FIG. 10.

A preferred embodiment of the device additionally features an openable front cover 50 that is attached to the first engaging member 40 by way of a hinge 52, as illustrated in FIGS. 10 and 11. Alternatively, the cover 50 could snap onto and off of the device 1. In any event, the purpose of the cover component 50 is to conceal the latching mechanism and make the device 1 more fashionable.

Although the present invention has been described in considerable detail and with reference to and illustration of a preferred version, it should be understood that other versions, which are not illustrated, are contemplated as being a part of the present invention. As a mere example, the latching mechanism described herein could be replaced by significantly different locking means for holding the inventive waist adjusting device in fixed position. As another example, the respective shapes and orientations of the engaging and connecting members, as well as that of a front cover, may vary from what is disclosed herein, as their pivot relationships are considerably more germane to the inventive concept than are the particular shapes of those constituent parts.

What is claimed is:

1. A pants waist adjusting device comprising:

a first engaging member having means for fastening directly onto the waist rim of a pair of pants at a first fasten point therealong;

a second engaging member having means for fastening directly onto the waist rim at a second fasten point therealong;

a connecting member that is pivotally connected to both engaging members, wherein the connecting member may be pivoted between a closed position and a range of open positions, wherein the closed position is defined by all three members being generally aligned and wherein pivoting toward the closed position draws the fasten points closer together and thereby produces a tighter pants waist fit about a wearer; and a latch pin for locking the engaging and connecting members in fixed relation; wherein the latch pin is slidably mounted in a chamber formed within the second engaging member, wherein the latch pin may be slid between an unlock position in which it is completely retracted into the second engaging member and a lock position in which it extends from the second engaging member, through a receiving hole formed within the connecting member and into a receiving slot formed within the first engaging member.

2. The adjusting device of claim 1, further comprising a decorative cover for concealing the engaging and connecting members.

3. The adjusting device of claim 1, wherein:

said first engaging member has a generally 90-degree rotated U shape;

said second engaging member has a generally 90-degree rotated T shape; and said connecting member has a generally 90-degree rotated U shape.

4. The adjusting device of claim 3, further comprising a decorative cover for concealing the engaging and connecting members.

5. The adjusting device of claim 1, further comprising:

a spring that is disposed within the chamber formed within said second engaging member, wherein the spring biases said latch pin toward its lock position; and a control element attached to said latch pin, the control element adapted for being pushed, by a user's finger, in order to slide said latch pin into its unlocked position.

6. A pants waist adjusting device comprising:

a first engaging member;

a first clip transversely attached to the first engaging member, wherein the first clip is adapted for attachment over the upper waist rim of a pair of pants at a first fasten point therealong;

a second engaging member;

a second clip transversely attached to the second engaging member, wherein the second clip is adapted for attachment over the upper waist rim of a pair of pants at a second fasten point therealong; and a connecting member that is pivotally connected to both engaging members, wherein the connecting member being pivotable between a closed position and a range of open positions, wherein the closed position is defined by the connecting and engaging members being generally aligned, and wherein pivoting toward the closed position draws the fasten points closer together and thereby produces a tighter pants waist fit about a wearer.

7. The adjusting device of claim 6, further comprising a latch pin for locking said engaging and connecting members in fixed relation; wherein the latch pin is slidably mounted in a chamber formed within said second engaging member, wherein the latch pin may be slid between an unlock position in which it is completely retracted into said second engaging member and a lock position in which it extends from said second engaging member, through a receiving hole formed within said connecting member and into a receiving slot formed within said first engaging member.

8. The adjusting device of claim 7, further comprising:

a spring that is disposed within the chamber formed within said second engaging member, wherein the spring biases said latch pin toward its lock position; and a control element attached to said latch pin, the control element adapted for being pushed, by a user's finger, in order to slide said latch pin into its unlocked position.

* * * * *